US006427393B1

(12) United States Patent
Chen et al.

(10) Patent No.: US 6,427,393 B1
(45) Date of Patent: Aug. 6, 2002

(54) SEISMIC-RESISTANT BEAM-TO-COLUMN MOMENT CONNECTION

(75) Inventors: Cheng-Chih Chen, Hsinchu; Ting Fu Wang, Taipei, both of (TW)

(73) Assignee: Sinotech Engineering Consultants, Inc. (TW)

( * ) Notice: Subject to any disclaimer, the term of this patent is extended or adjusted under 35 U.S.C. 154(b) by 0 days.

(21) Appl. No.: 09/771,176

(22) Filed: Jan. 26, 2001

(51) Int. Cl.[7] ..... E04H 1/00; E04B 1/19

(52) U.S. Cl. ..... 52/167.1; 52/93.1; 52/736.2; 403/230; 403/270

(58) Field of Search ..... 52/167.1, 736.2, 52/737.2, 93.1, 92.1, 92.2; 403/270, 271, 262, 230

(56) References Cited

U.S. PATENT DOCUMENTS 2,146,333 A * 2/1939 Deming ..... 403/231
3,938,297 A * 2/1976 Sato et al. ..... 403/188
4,409,765 A * 10/1983 Pall ..... 52/167.1
5,148,642 A * 9/1992 Plumier et al. ..... 52/167.1
5,271,197 A * 12/1993 Uno et al. ..... 52/167.1
5,595,040 A * 1/1997 Chen ..... 52/729.1
6,059,482 A * 5/2000 Beauvoir ..... 403/262
6,073,405 A * 6/2000 Kasai et al. ..... 52/283

* cited by examiner

*Primary Examiner*—Carl D. Friedman
*Assistant Examiner*—Brian E. Glessner
(74) *Attorney, Agent, or Firm*—Ostrolenk, Faber, Gerb & Soffen, LLP

(57) ABSTRACT

A structural steel seismic-resistant beam-to-column connection is provided with a pair of rib plates installed symmetrically above and below the connection. The rib plates are perpendicularly to an upper and a lower beam flange and disposed at positions corresponding to the center of the beam web. The rib has a variable cross section at its front end and a relatively lower lengthened section at its rear end. Through the use of the rib plate, the stress concentration at those fan type weld access holes of the beam web as well as the junction of the full penetration weld between the beam flange and column flange can be alleviated, and the plastic hinge can be limited to the beam at a specified portion and can develop excellent plastic rotation capacity in the case of a severe earthquake.

1 Claim, 3 Drawing Sheets

SEISMIC-RESISTANT BEAM-TO-COLUMN MOMENT CONNECTION

BACKGROUND OF THE INVENTION

1. Field of the Invention

The invention mainly relates to the seismic-resistant beam-to-column connections for use in the moment-resisting steel frames comprising beams and columns.

2. Description of the Prior Art

Steel structures are recognized to be capable of developing the required strength and ductility to resist the earthquake loading because of the ductile material property of the steel. Steel moment-resisting frames can provide excellent inelastic behavior under severe seismic loading. The inelastic behavior of a ductile steel moment-resisting frame is mainly attributed to the plastic deformations of the connections formed between beams and columns. Therefore, the beam-to-column connections shall be designed appropriately to have sufficient strength and inelastic deformation to dissipate large portion of the energy imposed from the earthquake.

The beams used in the present invention are typical I-shaped and wide flange sections. The conventional connections of the beams to columns are commonly achieved by bolted web and welded beam flanges to column flange. The weld between top and bottom beam flanges and column flange is usually a full penetration weld and performs in the field. Moreover, two fan type weld access holes in the beam web near the flange are needed to perform this full penetration weld. The presence of those weld access holes in the beam web causes the stress concentration near the center of the beam flange. As a result, brittle failure can occur in the connections because of a variety of influences, such as weld defect, weld access hole, and stress concentration.

These widely used conventional beam-to-column connections were found failed in suffering the catastrophe after the ruthless test of Northridge earthquake in 1994. The failures of the connections include the buckling and fracture of the flange and web of the beam and column, fracture of the shear tab, and weld tearing between beam and column. The observed damage prevented the welded beam-to-column connections from the intended inelastic behavior to resist earthquake ground shaking.

Numerous researches were, then, undertaken to improve the behavior of such beam-to-column connections of the previous art. Some modified moment connections have been developed to upgrade and to resist seismic demands through the improvement of the inelastic behavior of the connections. The recent improved connections include the strengthened connections and reduced beam section connections.

It is the object of present invention to provide a steel structure that has stable strength and stiffness and maintains its integrity through inelastic deformation during severe earthquake. The present invention is to guarantee an excellent inelastic behavior of the beam-to-column connection.

SUMMARY OF THE INVENTION

This aim is achieved by providing an improved beam-to-column connection. The improved connection reduces the stress concentration of the beam flange caused by the weld access hole. This stress concentration causes the potential cracking initiated in the root of the weld access hole and the cracking will spread and tear the weld. As a result, the connection will fail in a brittle manner. The improvement of present invention is to provide evenly distribution of the stress across the connection.

The present invention is further to provide the occurrence of the plastic hinge of the beam under a severe earthquake away from the surface of the column. The formation of the plastic hinge of the beam away from the column flange results in the assurance of the large plastic rotations that permit hysteretic dissipation of earthquake-induced energy.

The present invention is furthermore to increase the plastic rotation capacity through the guarantee of the presence of an extended energy dissipative zone in the beam. The seismic-resistant ability is enhanced through the use of the improved connection that is demonstrated and based upon the discovery of non-linear finite element analysis as well as full-scale structural experiment.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE PREFERRED EMBODIMENTS

Figure 1:
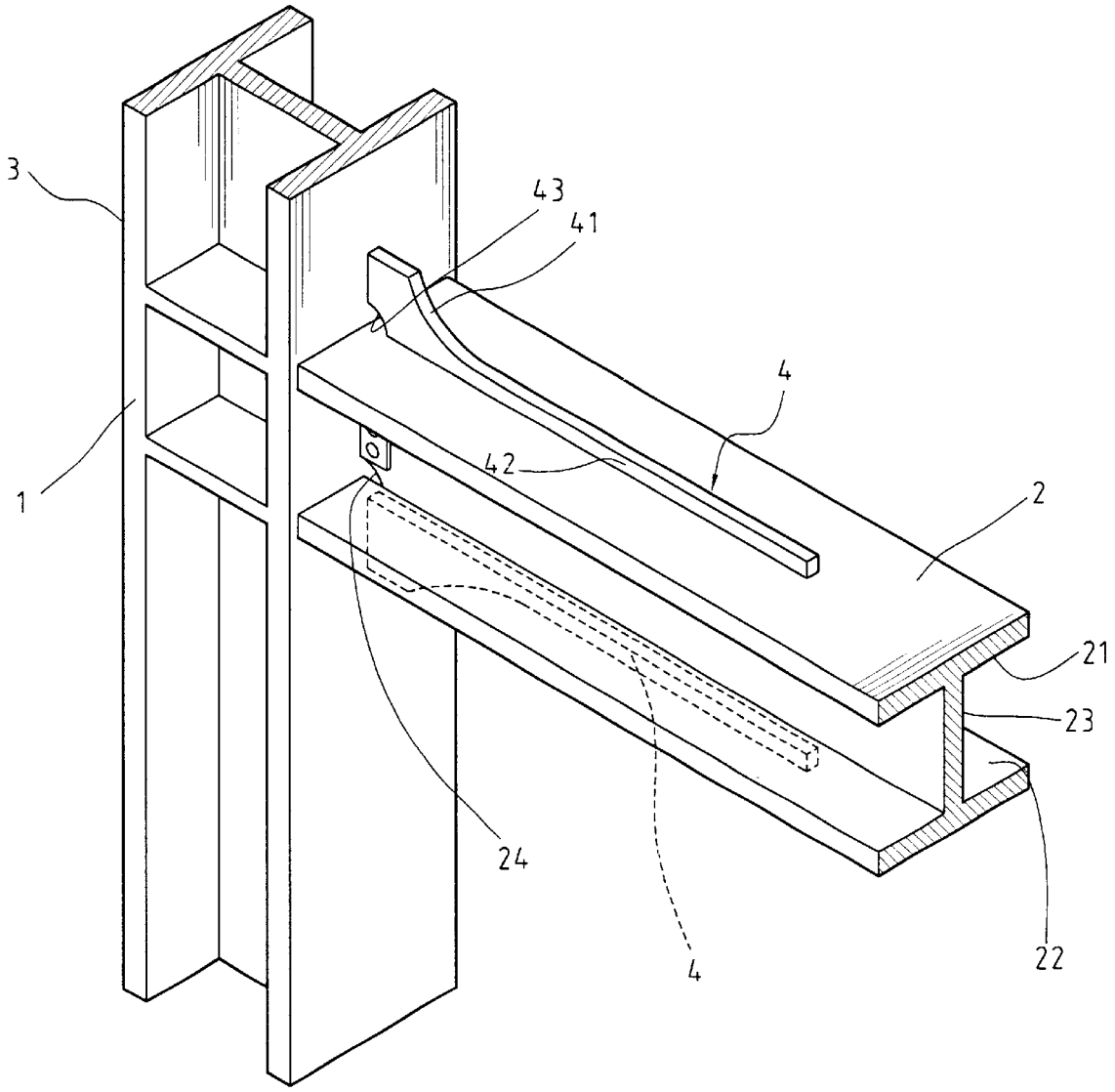
FIG. 1 is a perspective view of the present invention.
Figure 2:
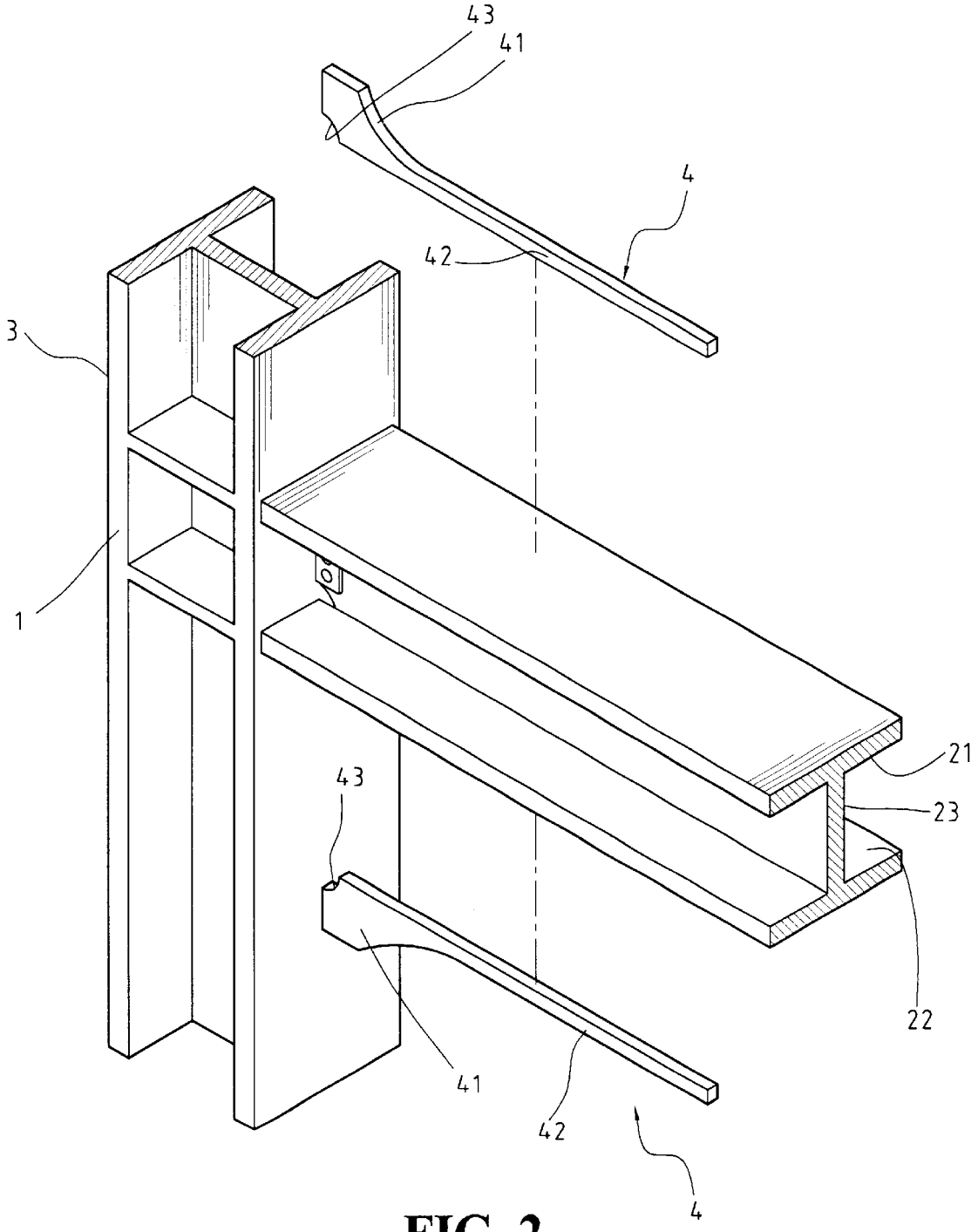
FIG. 2 is an exploded view of the present invention.

Please refer to FIG. 1 and FIG. 2, concerning a perspective view and an exploded view of the present invention, wherein a structural steel seismic-resistant connection (1) of beam and column is provided with a pair of symmetric rib plates (4) welded at the connection of a beam (2) and a column (3). A variable cross section (41) is formed at the front end of the rib plate (4), and a relatively lower lengthened section (42) is arranged at the rear side of the variable cross section (41). The rib plates (4) are disposed perpendicularly to an upper and a lower beam flange (21) (22) at positions corresponding to a beam web (23) of the beam (2). Also, an arciform fan type opening (43) is disposed adjacent to the connection of the beam and column so as to reserve a space for welding the upper flange (21) of the beam (2) and for passing through a backing plate of the lower beam flange (22) of the beam (2). Finally, through the installation of the rib plates (4), the phenomena of stress concentration between the connection (1) of the beam (2) and the column (3) at a fan type opening (24) of the beam (2) and the high stress occurred at the full penetration weld between the beam flange (21) and the column (3) can be improved. Namely, the plastic hinge is arranged to take place at a position in the beam (2) corresponding to the rib plate (4) when a severe earthquake occurs. Further, the yielding zone can be enlarged in the beam (2) at a place corresponding to the lengthened section (42) of the rib plate (4) so as to increase the plastic rotation and the energy dissipative function of the beam (2).

Figure 3:
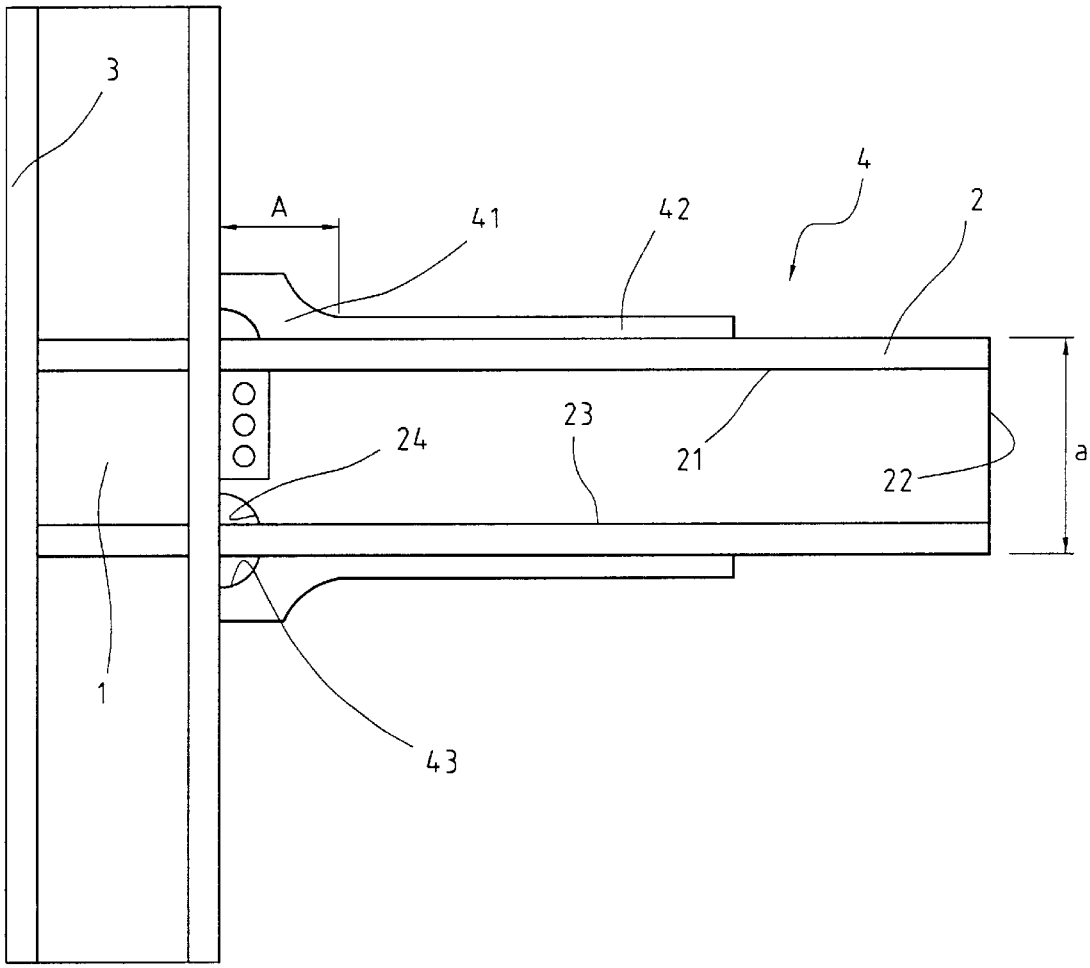
FIG. 3 is a front view of the present invention.

FIG. 3 illustrates a front view of the present invention. The symmetric rib plates (4) are disposed at the connection (1) of the beam (2) and column (3), wherein the variable cross section (41) is located at the front end of the rib plate (4), and the variable cross section length (A) of the variable cross section (41) measured from the surface of the column (3) to the front end of the lengthened section (42) is equal to the length from the one-third of the beam depth (a) to the full beam depth (a). The relatively lower lengthened section (42)

is extended from the variable cross section (41). The rib plate (4) is connected to the beam flanges (21) (22) and the column (3) by welding, wherein the thickness of the rib plate (4) is limited thinner than the double thickness of the beam web (23). The length of the lengthened section (42) of the rib plate (4) is limited at least the half of the beam depth (a) of the beam.

In the above described, at least one preferred embodiment has been elucidated with reference to drawings annexed, it is apparent that numerous variations or modifications may be made without departing from the true spirit and scope thereof, as set forth in the claims below.

What is claimed is:

1. A structural steel seismic-resistant beam-to-column connection, mainly comprising:

a connection formed by an H-beam and a column, said H-beam being comprised of an upper flange, a lower flange extending parallel to said upper flange and a web connected perpendicularly to said upper flange and said lower flange; and a pair of symmetric rib plates, said rib plates being perpendicularly welded at suitable places on said upper flange and said lower flange of said H-beam respectively and disposed at positions corresponding to said web of said H-beam, each one of said rib plates having a variable cross section disposed at its front end and welded at an end portion thereof to said column and a relatively lower lengthened section at its rear end, wherein a thickness of said rib plate is thinner than double the thickness of said web of said H-beam, a length of said variable cross section measured from said connection of said H-beam and column to a front end of said lengthened section is equal to a length from a position located at one-third of a depth of said H-beam to a full depth of said H-beam, and a length of said lengthened section of said rib plate is longer than half of said depth of said H-beam, said depth of said H-beam being equal to the distance between the outer surfaces of said upper flange and said lower flange.

* * * * *